US007896792B2

(12) United States Patent
Natterer

(10) Patent No.: US 7,896,792 B2
(45) Date of Patent: Mar. 1, 2011

(54) PACKAGING MACHINE AND METHOD FOR CUTTING PACKAGES

(75) Inventor: Johann Natterer, Legau (DE)

(73) Assignee: Multivac Sepp Haggenmuller GmbH & Co. KG (DE)

( * ) Notice: Subject to any disclaimer, the term of this patent is extended or adjusted under 35 U.S.C. 154(b) by 276 days.

(21) Appl. No.: 11/127,641

(22) Filed: May 12, 2005

(65) Prior Publication Data

US 2005/0252351 A1 Nov. 17, 2005

(30) Foreign Application Priority Data

May 17, 2004 (DE) ..... 10 2004 024 358

(51) Int. Cl.
*B31B 1/14* (2006.01)
*B31B 43/00* (2006.01)

(52) U.S. Cl. ..... 493/62; 493/354

(58) Field of Classification Search ..... 493/61, 493/60, 354, 342, 339–40, 353–4; 83/45–47, 83/56, 58, 342, 366, 404–408, 213, 255, 83/946, 35, 39, 49, 945
See application file for complete search history.

(56) References Cited

U.S. PATENT DOCUMENTS

| | | | | |
|---|---|---|---|---|
| 336,335 | A * | 2/1886 | McDonald | 83/134 |
| 1,957,864 | A * | 5/1934 | Tuttle et al. | 355/77 |
| 2,015,857 | A * | 10/1935 | Leo | 426/573 |
| 3,238,691 | A | 3/1966 | Miller et al. | |
| 3,673,760 | A | 7/1972 | Canamero et al. | |
| 3,759,122 | A * | 9/1973 | Lane et al. | 83/24 |
| 3,888,066 | A | 6/1975 | Tabur | |
| 4,043,234 | A * | 8/1977 | Godin et al. | 83/40 |
| 4,253,364 | A | 3/1981 | Kiefer et al. | |
| 4,265,104 | A * | 5/1981 | Todeschini | 72/330 |
| 4,441,391 | A * | 4/1984 | Seaman | 83/165 |
| 4,565,052 | A | 1/1986 | Hautemont | |
| 5,397,106 | A * | 3/1995 | Hill | 270/58.34 |
| 5,606,847 | A * | 3/1997 | Joensson et al. | 53/471 |
| 2002/0152865 | A1 * | 10/2002 | Betti | 83/214 |

FOREIGN PATENT DOCUMENTS

| | | |
|---|---|---|
| DE | 1 511 634 | 8/1970 |
| DE | 25 06 446 | 8/1976 |
| DE | 31 18 946 A1 | 12/1982 |
| DE | 32 05 277 A1 | 8/1983 |
| DE | 38 41 250 A1 | 6/1990 |
| EP | 0 280 659 | 8/1988 |
| EP | 0 485 208 A1 | 5/1992 |
| GB | 2101030 A | 1/1983 |
| JP | 54-140379 | 9/1979 |
| JP | 62-114897 | 5/1987 |
| JP | 63-201090 | 12/1988 |

* cited by examiner

*Primary Examiner* — Rinaldi I. Rada
*Assistant Examiner* — John Paradiso
(74) *Attorney, Agent, or Firm* — Brooks Kushman P.C.

(57) ABSTRACT

A packaging machine and a method for cutting packages is provided in which containers (4) are formed from a web of film (1) and transported through working stations of the packaging machine in a fixed-cycle way. After filling and sealing, the web of film (1) comprising the containers (4) is cut transverse to the transport direction (12) in a first cutting station (9) and in a succeeding second cutting station (10) cut in transport direction such that singularised packages result. The second cutting station (10) is operated intermittently in a fixed-cycle way and preferably is formed as a punch. By this, a precise taking-over of the packages for the subsequent processing is possible.

20 Claims, 6 Drawing Sheets

PACKAGING MACHINE AND METHOD FOR CUTTING PACKAGES

FIELD OF THE INVENTION

The invention relates to a packaging machine and to a method for cutting packages.

BACKGROUND OF THE INVENTION

From DE 38 41 250 A1 a packaging machine according to the preamble of claim 1 is known. This packaging machine has a transverse cutting device and, arranged in succession, a longitudinal cutting device. The longitudinal cutting device cuts the packages in the longitudinal direction of a web by means of a rotating blade. This device requires regular maintenance and adjustment operations. Furthermore, the service life of the blades is limited and the quality of the cut is not sufficient for high-quality packages. The longitudinal cutting device runs continuously during the advance of the packages.

From DE 25 06 446 a packaging machine is known in which the separating of the packages is also performed in two steps. First, a web is cut in the transverse direction to thereafter cut out strips which are separated into single packages in a further device. Each package is separately cut off the strip and, therefore, the capacity is limited.

In DE 31 18 946 A1 a device for cutting out packages from a web of film is proposed in which the outline of the packages is cut in one working step. The device consists of a complicated unit comprising a press with high forces and a cutting tool which is individually adapted to the number, size and outline of the packages. The output of the packages from the device is laborious.

SUMMARY OF THE INVENTION

It is the object of the invention to provide a packaging machine and a method for cutting packages with which packages are produced with a high quality of cut, a high output yield is achieved, and the packages are provided in an easily accessible way for the further processing.

The object is attained by a packaging machine according to claim 1 and by a method for cutting packages according to claim 9.

The invention in particular has the advantage that taking over of the cut packages can be performed from above and with high precision. Furthermore, by dividing the working steps in respect of the first and the second cuttings, a higher flexibility in specific applications is possible.

BRIEF DESCRIPTION OF THE DRAWINGS

Further features and advantages of the invention will arise from the description of embodiments with reference to the enclosed figures.

The figures show.

DETAILED DESCRIPTION OF EMBODIMENTS OF THE INVENTION

Figure 1:
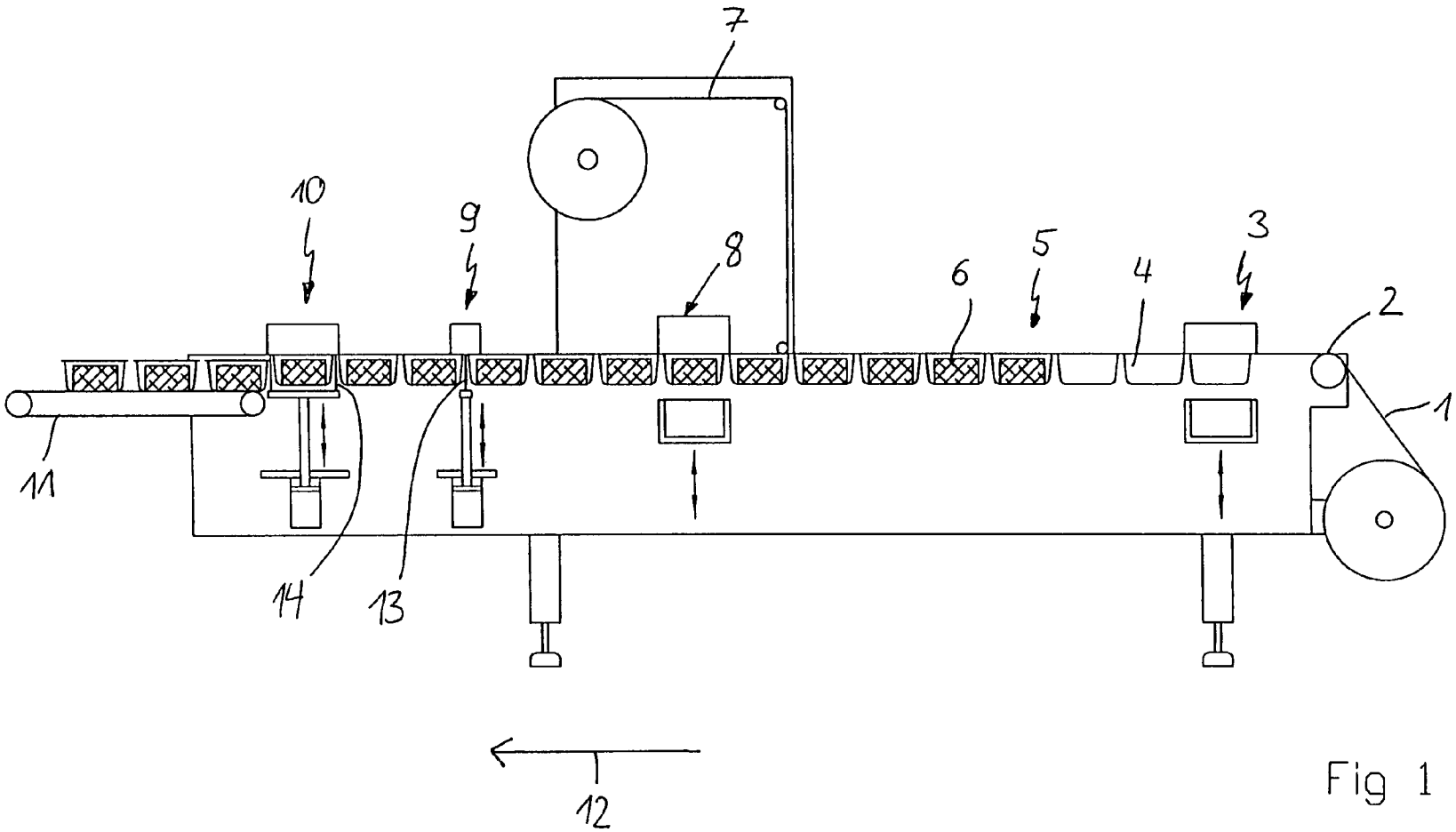
FIG. 1 a schematic view of a packaging machine according to a first embodiment with the front cover omitted.

As can be seen in FIG. 1, at its input side the packaging machine comprises a roll of film with a first web of film 1 which is taken hold of by a transport device 2 on both sides and which is transported to an output side. In a forming station 3 containers 4 formed from the web of film 1 are created. As can be seen from FIGS. 2 and 3, several containers 4 are arranged in a row over the width of the web of film 1. As an option, a filling station 5 is provided in which the containers 4 are filled with products 6. In succession thereof, a supply for a second web of film 7 with which the containers 4 are covered and sealed in a sealing station 8 is located. Further, a first cutting station 9 is provided in which the web of film containing the containers is cut in a first direction on two opposing sides of the containers. In the transport direction 12 downstream of the first cutting station 9, a second cutting station 10 is provided in which the web of film 1 is cut in a second direction on opposing sides of the containers. Behind the second cutting station 10 a transport device 11 is provided which conveys the completely separated containers coming out from the second cutting station 10 to a transfer station (not shown). The transport device 2 is formed such that it advances the web of film in a fixed-cycle way wherein the period of time in which the transport device is stationary in a working cycle at least corresponds to the time the station with the longest operating time needs for the working process.

In the embodiments shown in FIGS. 1 to 3 the first cutting station 9 is formed as a transverse cutter which preferably is a punch and comprises a punch knife 13 extending transverse to the transport direction 12 and arranged below the web of film which presses the web of film 1 against an abutment arranged above the web of film and, in doing so, punches through it. Anyhow, the inverse arrangement is possible as well in which the punch knife 13 is located above the web of film and the abutment below. Further, a control is provided which operates the first cutting device 9 in accordance with the fixed-cycle advance of the transport device 2 in an intermittent fixed-cycle way such that the cutting of the web of film transverse to the transport direction 12 is performed when the transport device is stationary between to advances.

Figure 2:
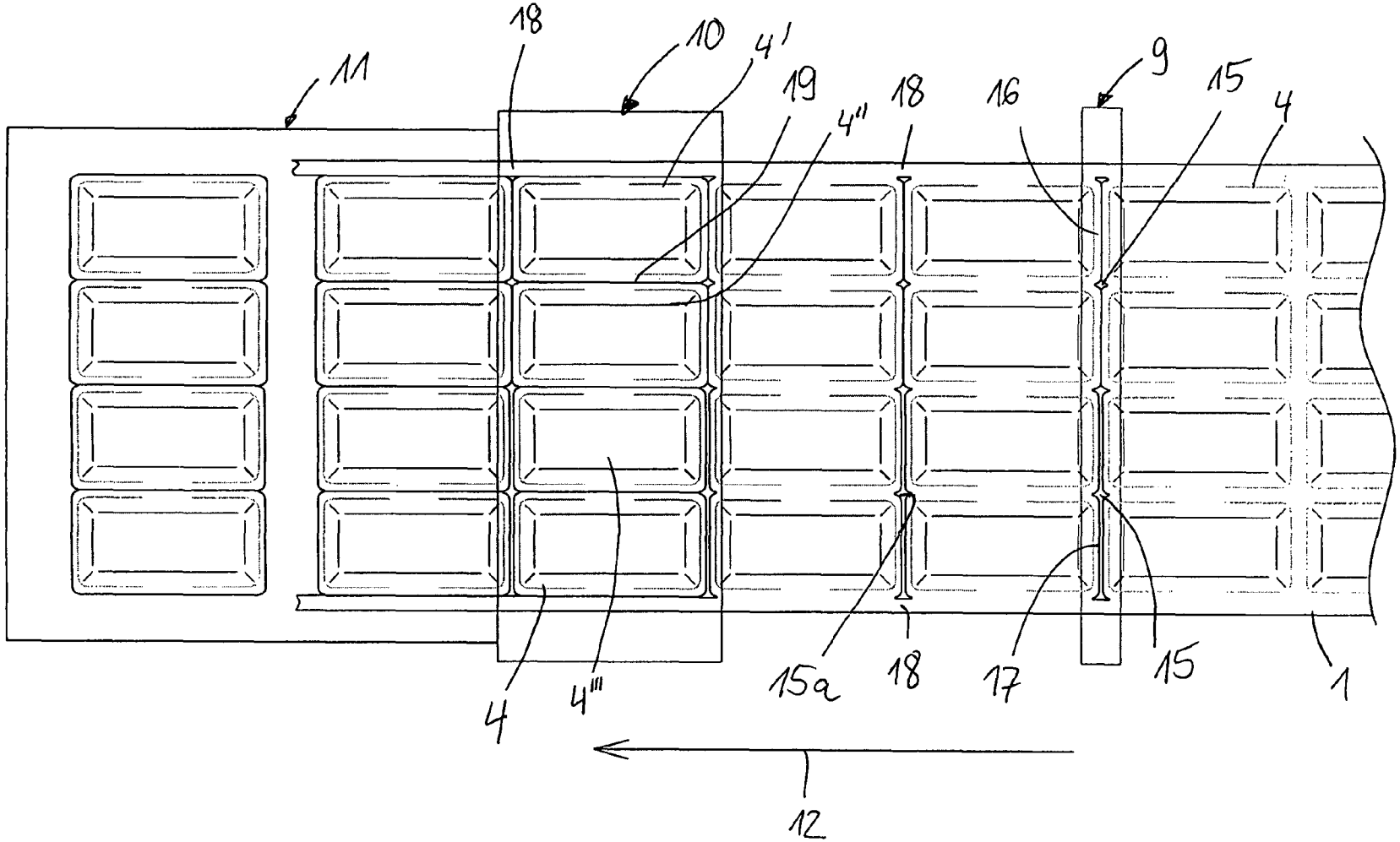
FIG. 2 a top view onto the packaging web of the packaging machine according to FIG. 1 in the region of the transverse and the longitudinal cuttings according to a first embodiment.
Figure 5:
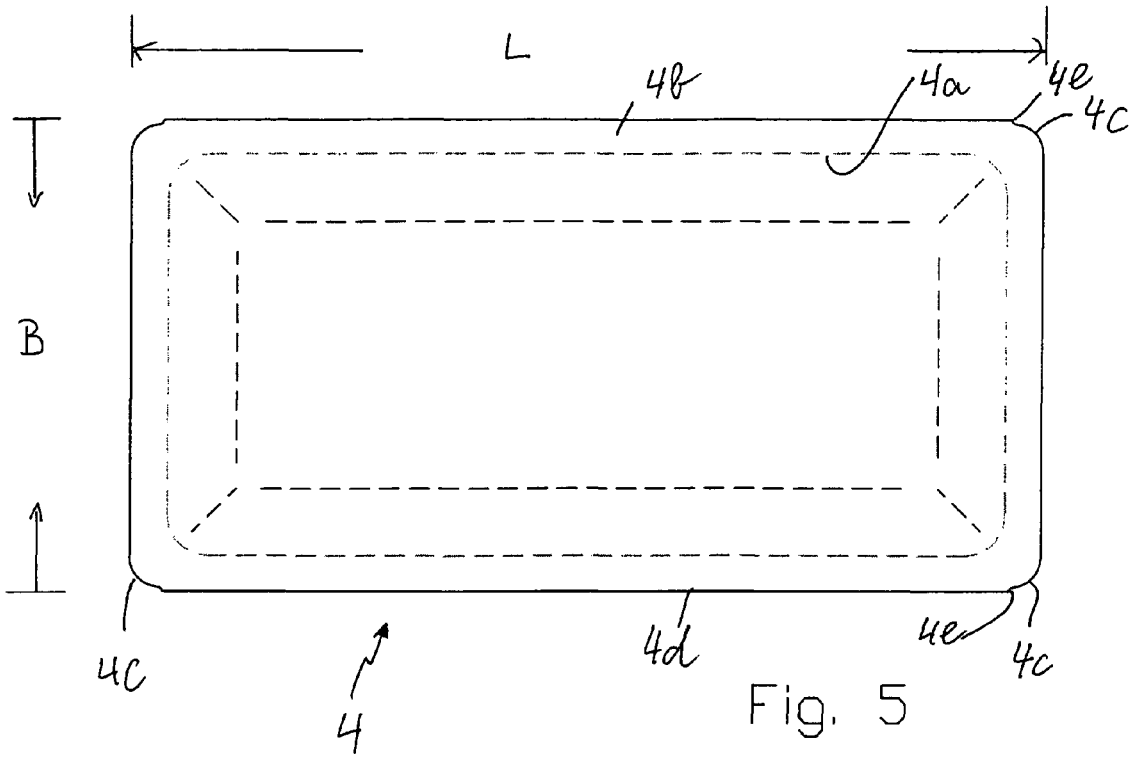
FIG. 5 a top view onto a package produced with the embodiment according to FIG. 2.

In a first embodiment of the geometry of the punch knife 13 which is shown in FIGS. 2 and 5, the punch knife 13 of the first cutting station 9 is formed such that it cuts, between the containers 4, star-shaped cut-outs 15 with curvatures 15*a* directed to the inside which later on, as can be seen in FIG. 5, form rounded corners 4*c* of the cut out containers. As can be seen in the upper half of FIG. 2, the punch knife 13 in a first example may be formed such that line-shaped cuts 16 are created between the containers 4 transverse to the transport direction 12. As can be seen in the lower half of FIG. 2, in a second example the punch knife 13 may be formed such that strip-shaped cut-outs 17 are created between the star-shaped cut-outs 15. Further, the punch knife 13 does not extend over the whole width of the web of film 1 and, therefore, a strip 18 remains at the side edges of the web of film 1, respectively. The strip serves for advancing the web of film.

As can be seen in FIGS. 1 to 3 and 7, the second cutting station 10 is formed as a longitudinal cutter and preferably as a punch which comprises a plurality of punch knives 14 having their cutting edges extending in the transport direction 12 and arranged below the web of film 1 pressing against an abutment 14*a* located above the web of film 1 and, in doing so, punching through the web of film. Here as well, the inverse arrangement is possible in which the punch knives 14 are located above the web of film and the abutment is below. As shown in FIG. 5, the distance B between the punch knives 14 is wider than the width of the cavities 4*a* of the pre-formed containers 4 having the result that, after the complete separating, a container 4 comprising a rim 4*b* and having an overall width B is created. The number of punch knives is by 1 larger than the number of containers 4 arranged side by side transverse to the transport direction 12 in a transverse row. The length of the punch knives corresponds to the length L of the container shown in FIG. 5. In a first embodiment of the geometry of the punch knives 14 as shown in FIG. 2, these are formed such that line-shaped cuts 19 are created in the transport direction 12. The distance of the two outermost punch knives relative to each other is smaller than the width of the web of film 1 and as wide as the length of the punch knife 13 of the first cutting station, having the result that rim portions 18 which constitute waste remain after cutting.

Further, a control is provided which operates the second cutting station 10 in accordance with the fixed-cycle of the transport device in an intermittent fixed-cycle way such that the cutting in the transport direction is performed when the transport device is stationary between to advances and that, when the cut is effected, the punch knives and the abutment are moved away from the web of film such that an access to the containers from above is allowed for.

During operation, first the web of film 1 is supplied to the forming station 3 via the transport device 2 in a fixed-cycle way. The containers 4 are deep-drawn in the forming station 3. Then, as an option the containers are filled with products 6 in a filling station 5 and closed with the upper film 7 and sealed in the sealing station 8. The thus-connected containers are transported on in a fixed-cycle way by the transport device 2 and supplied to the first cutting station 9 which effects the cut shown in FIG. 2 in a direction transverse to the transport direction 12 intermittently in a fixed-cycle way, while the respective transverse rows of containers in front of and behind the cutting station 9 are stationary. Since the rim portions 18 remain, the web of film 1 can further be held thereon and transported on. As soon as a transverse row of containers arrives in the second cutting station 10, the punch knives 14 are operated there and a plurality of longitudinal cuts 19 is created which open out to the star-shaped cut-outs 15 and, in doing so, completely separate the containers 4 from each other.

After each step the punch knives 14 and the abutments 14*a* are moved away from the web of film such that the decollated containers are freely accessible from above while they are transported on the transport device 11. By this, a taking-over with high precision for the further processing is allowed for since the containers have a defined distance relative to each other.

As shown in FIG. 5, the cut-out container comprises rounded corners 4*c* the curvature of which is created by the star-shaped cut-outs 15. Between a rounded corner 4*c* and a longitudinal side 4*d* of the container, a small corner 4*e* exists which arises due to the fact that the distance of the punch knives 14 of the second cutting station 10 is not exactly adjusted to the curvature of the star-shaped portion 12 which is punched out by means of the first cutting station. The corner may be utilised as assistance for peeling off the upper film 7 during opening of the container 4 at a later date.

As can be seen in FIG. 2, the containers 4', 4" in the upper part are formed without cutting waste at their short sides, while the containers 4 and 4''' in the lower part are formed with a cutting waste at their short sides. This results from the punching out of the strips 17 in the first cutting station.

Figure 3:
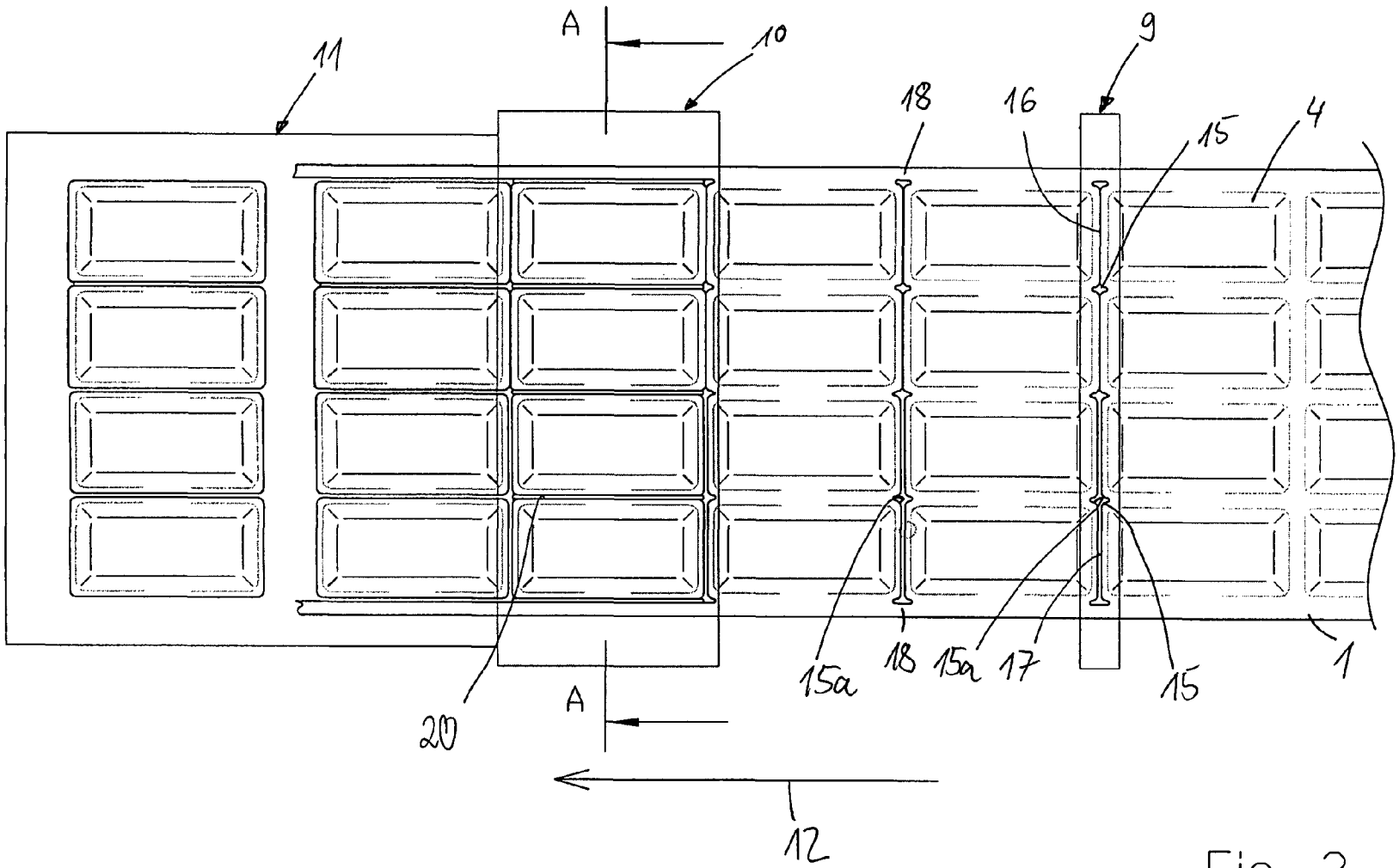
FIG. 3 a top view onto the packaging web according to a second embodiment.
Figure 6:
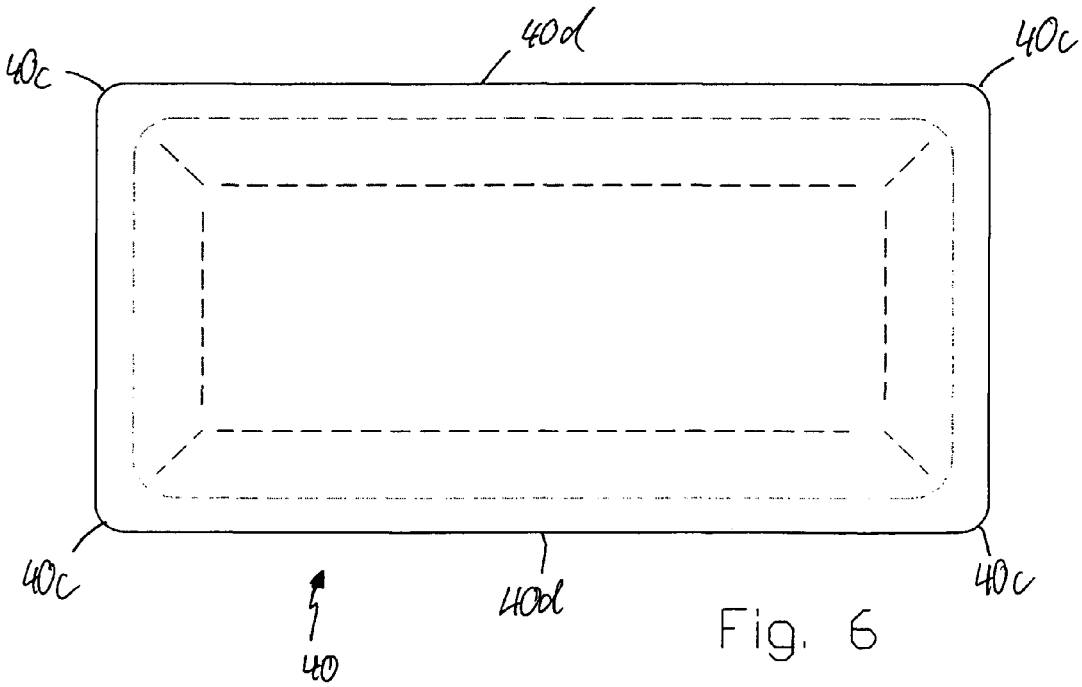
FIG. 6 a top view onto a package produced according to the embodiment according to FIG. 3.
Figure 7:
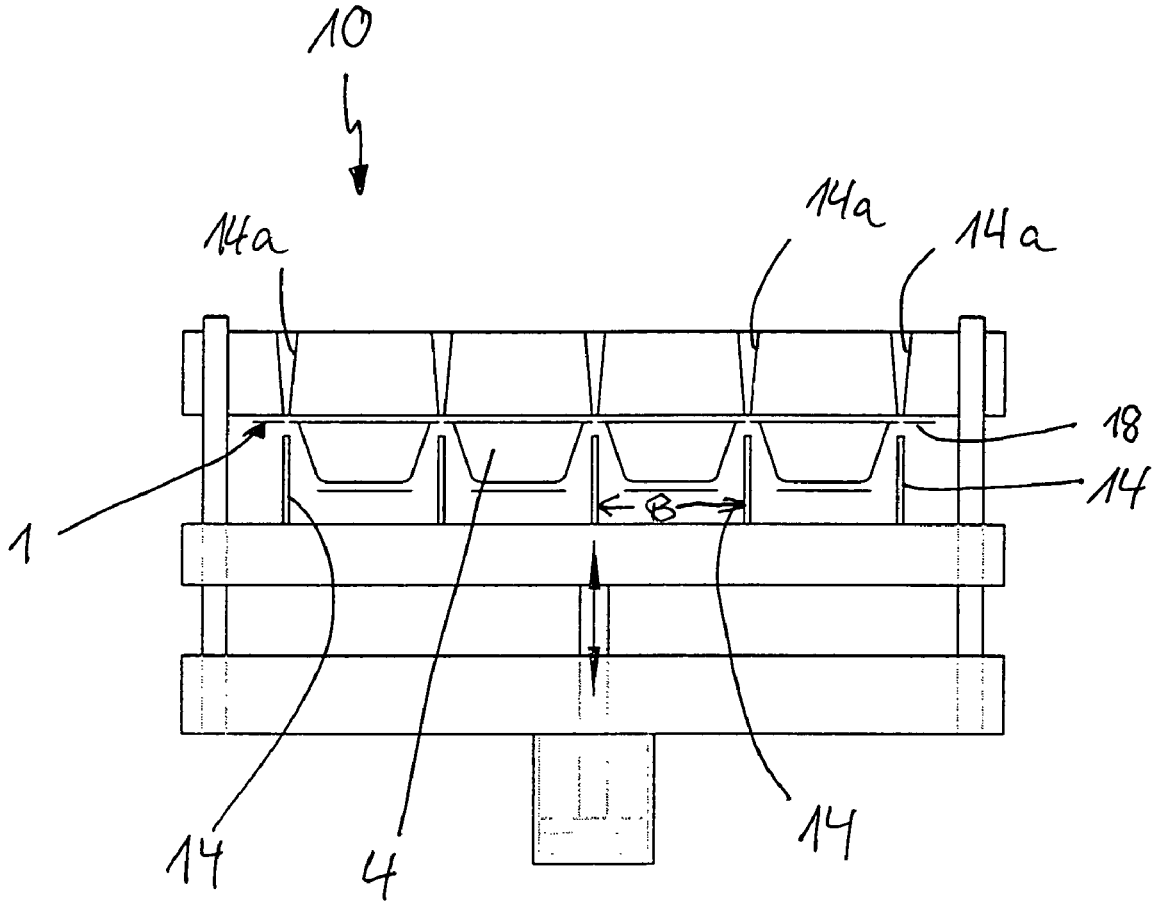
FIG. 7 a section taken along line A-A of the cutting station according to FIG. 3.

In the second embodiment of the geometry of the punch knives of the second cutting station 10 as shown in FIG. 3, the punch knives are formed such that in between and at the end of the longitudinal sides of the respective containers 4 longitudinal strips 20 are punched out. Due to this, packages 40 as shown in FIG. 6 are created. A package 40 differs from the package 4 shown in FIG. 5 in that, due to the cutting out of the strips 20, the corner 4*e* is not present and the rounded edges 40*c* step-free merge into the longitudinal sides 40*d*.

The selection of the geometry of the punch knives is carried out depending on the packaging material and on the requirements to the quality of the cut edge of the container.

Figure 4:
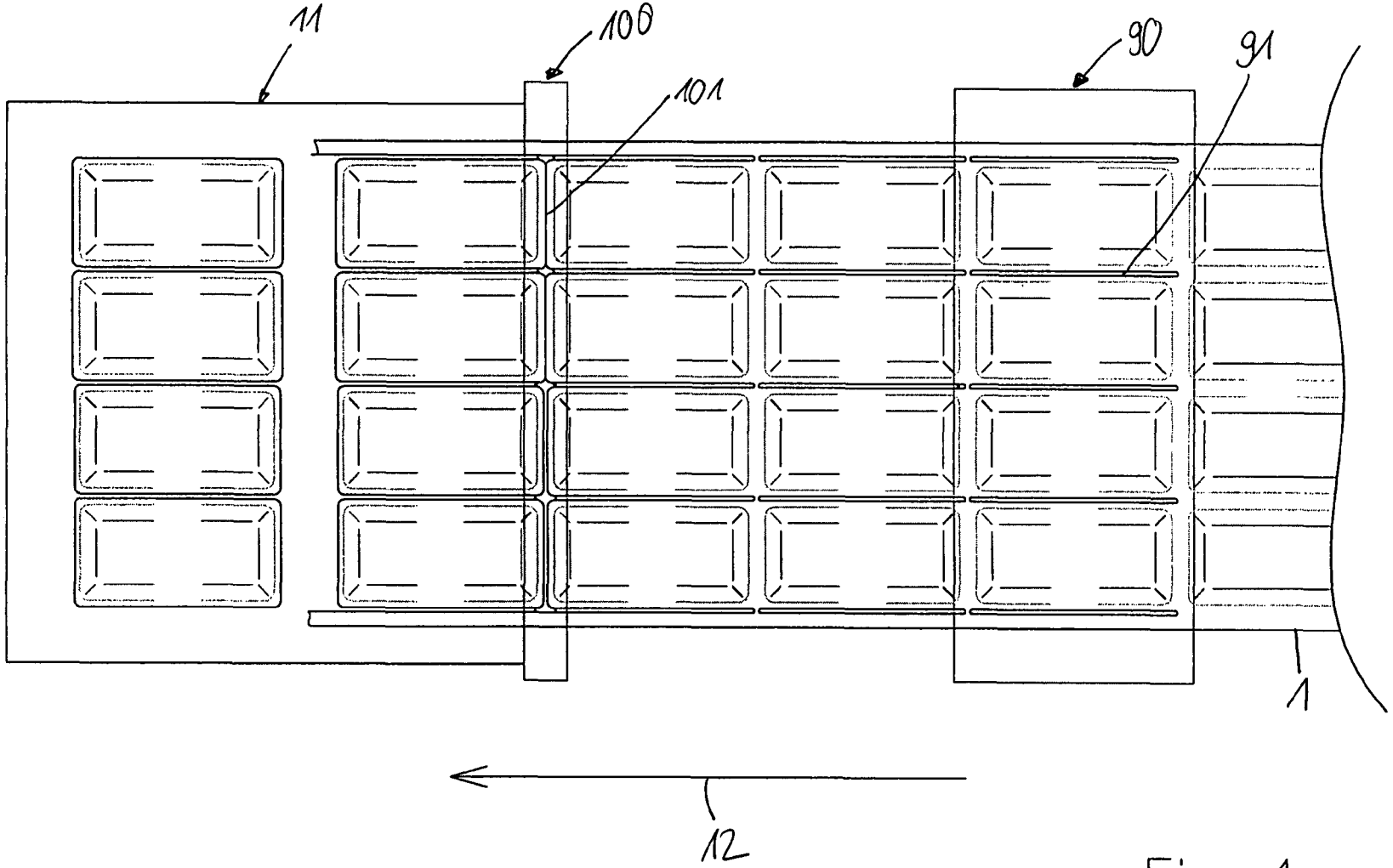
FIG. 4 a top view onto the packaging web according to a third embodiment.

In a modified embodiment of the packaging machine which is schematically shown in top view in FIG. 4, the first cutting station 90 is formed as longitudinal cutting station in which longitudinal cuts 91 are created between the packages. The second cutting station 100 is formed as transversal cutting device in which one or more cuts transverse to the transport direction 12 are created. By the second cutting station 100 operating intermittently, here as well, a precise taking-over is possible, for example by means of a manipulation apparatus from above.

Modifications of the embodiments described above are possible. For example, the first cutting station 9, 90 not necessarily has to be formed as a punch but may also be a simple cutting by knives. The geometries of the punch knives are adapted to the requirements. The star-shaped punch-out not necessarily has to be present; if not, packages having pointed corners are created.

The longitudinal cutter may also be formed as a shear blade such that the longitudinal edges are cut waste-free.

It is also possible to deep-draw, fill, seal and cut multiple containers in a row in transport direction simultaneously. In this case, the cutting device formed as transverse cutter comprises a plurality of parallel cutting blades.

Further, the invention is not restricted to a packaging machine in the form of a deep-drawing machine but may also be applied in a forming machine for packaging containers.

What is claimed is:

1. A method for cutting packages in a packaging machine in which the packages are produced from a web of film which is transported in a transport direction from an input side to an output side of the packaging machine in a fixed-cycle way, comprising the steps of:

creating a first cut in a first direction on the web of film with a first cutting device, the web of film having multiple containers formed therein, the first direction being transverse to the transport direction of the web of film, and the first cut being a width less than a full width of the web of film at a point where the first cutting device acts on said web of film and thereby leaving a strip at each edge of the web of film; and subsequently creating a second cut in a second direction on the web of film with a separate second cutting device arranged downstream of the first cutting device in the transport direction;

wherein said creating of the first cut and said creating of the second cut are each performed intermittently in a fixed-cycle way when the web of film is stationary between two advances, and the second cutting device is configured to completely separate adjacent containers from each other, and wherein the method further comprises moving the containers from the first cutting device to the second cutting device using a transport device that moves the web of film.

2. The method for cutting packages in a packaging machine according to claim 1, wherein the second cut is created by means of a punch.

3. The method according to claim 1, wherein the second cut is performed in the longitudinal direction of the web of film.

4. The method according to claim 1, wherein in at least one of the steps curvatures are created at the package corners.

5. The method according to claim 1, wherein in at least one of the steps strips are cut out.

6. The method according to claim 1, wherein the cutting of the longitudinal edges is performed waste-free.

7. The method according to claim 1, wherein one or both of the first and second cutting devices are moved away from the web of film permitting access to the packages from above between cutting operations.

8. The method of claim 1 wherein creating of the first cut is performed such that the first cutting device does not move with the web of film in the transport direction.

9. The method of claim 8 wherein creating of the second cut is performed such that the second cutting device does not move with the web of film in the transport direction.

10. A method for cutting containers in a packaging machine from a web of film that is transported in a transport direction in a fixed-cycle way, the method comprising:

forming multiple first cuts in a first direction in the web of film with a first cutting device, the web of film having multiple containers formed therein, the first direction being transverse to the transport direction of the web of film, and each first cut having a width less than a full width of the web of film thereby leaving a strip at each side edge of the web of film, such that multiple containers remain connected together in a row that extends in the first direction and such that the row of connected together containers remain connected to the strips;

moving the row of connected together containers in the transport direction to a second cutting device using a transport device that holds both side edges of the web of film, wherein the second cutting device is separate from the first cutting device and is arranged downstream of the first cutting device in the transport direction; and subsequently forming multiple second cuts in a second direction in the web of film with the second cutting device to completely separate the connected together containers from each other;

wherein the forming of the first cuts and the forming of the second cuts are each performed intermittently in a fixed-cycle way when the web of film is stationary between two advances.

11. A packaging machine for producing packages from a web of film comprising:

a transport device for transporting the web of film in a transport direction in a fixed-cycle way;

a forming station for forming multiple containers in the web of film;

a first cutting device for creating a first cut in a first direction on the web of film, wherein the first cutting device is a transverse cutting device cutting the web of film transverse to the transport direction and the first cutting device is sized and shaped to cut less than a full width of said web of film at a point where the first cutting device acts on said web of film to leave a strip at each edge of the web of film; and a separate second cutting device arranged in the transport direction downstream of the first cutting device for creating a second cut in a second direction on the web of film;

wherein the first cutting device and the second cutting device each cut intermittently in a fixed-cycle way when the transport device is stationary between two advances, the transport device moves the containers from the first cutting device to the second cutting device by moving the web of film, and the second cutting device completely separates the containers from each other.

12. A packaging machine for producing packages from a web of film according to claim 11, wherein the second cutting device is formed as a punch.

13. A packaging machine according to claim 11, wherein the second cutting device is a longitudinal cutting device cutting the web of film in the transport direction.

14. A packaging machine according to claim 11, wherein at least one of the cutting devices is formed such that it creates curvatures at the package corners.

15. A packaging machine according to claim 11, wherein at least one of the cutting devices is formed such that it cuts strips from the web of film.

16. A packaging machine according to claim 11, wherein one of the cutting devices is a longitudinal cutting device cutting the longitudinal edges of the web of film waste-free.

17. A packaging machine according to claim 11, wherein the packaging machine is a deep-drawing machine.

18. A packaging machine according to claim 11, wherein the first cutting device and the second cutting device are both punch cutters, each having an associated abutment, and wherein both the first and second cutting devices and associated abutments are movable away from the web of the film such that the access to the containers from above is permitted.

19. A packaging machine according to claim 11 wherein the first cutting device does not move with the web of film.

20. A packaging machine according to claim 19 wherein the second cutting device does not move with the web of film.

* * * * *